US009362691B2

(12) United States Patent
Ma

(10) Patent No.: US 9,362,691 B2
(45) Date of Patent: Jun. 7, 2016

(54) RECEPTACLE CONNECTOR

(71) Applicant: LOTES CO., LTD, Keelung (TW)
(72) Inventor: Liang Liang Ma, Keelung (TW)
(73) Assignee: LOTES CO., LTD, Keelung (TW)

( * ) Notice: Subject to any disclaimer, the term of this patent is extended or adjusted under 35 U.S.C. 154(b) by 0 days.
(21) Appl. No.: 14/575,897
(22) Filed: Dec. 18, 2014
(65) Prior Publication Data
US 2016/0079719 A1 Mar. 17, 2016
(30) Foreign Application Priority Data
Sep. 11, 2014 (CN) ..... 2014 2 0528230 U
(51) Int. Cl.
*H01R 24/00* (2011.01)
*H01R 24/58* (2011.01)
(52) U.S. Cl.
CPC ..... *H01R 24/58* (2013.01)
(58) Field of Classification Search
CPC ..... H01R 24/58; H01R 2103/00; H01R 2107/00; H01R 2105/00
USPC ..... 439/668, 669, 385
See application file for complete search history.

(56) References Cited

U.S. PATENT DOCUMENTS 7,198,504 B2 * 4/2007 Chien ..... G02B 6/4201 439/385
7,318,753 B2 * 1/2008 Chung ..... H01R 13/65802 439/607.01
7,789,712 B1 * 9/2010 Peng ..... H01R 24/58 439/668
7,794,285 B1 * 9/2010 Huang ..... H01R 24/58 439/668
7,806,734 B1 * 10/2010 Yu ..... H01R 24/58 439/668
7,867,037 B2 * 1/2011 Chen ..... H01R 24/58 439/668
7,878,864 B2 * 2/2011 Wang ..... H01R 13/7033 439/668
7,887,376 B1 * 2/2011 Zhang ..... H01R 13/6594 439/108
7,922,542 B1 * 4/2011 Shu ..... H01R 24/58 439/188
8,100,726 B2 * 1/2012 Harlan ..... H01R 13/2414 29/883
8,951,073 B2 * 2/2015 Zhang ..... H01R 13/41 439/676
2007/0249235 A1 * 10/2007 Wu ..... H01R 13/41 439/668
2009/0298347 A1 * 12/2009 Wu ..... H01R 13/7033 439/668
2010/0130043 A1 * 5/2010 Wang ..... H01R 13/7033 439/188
2011/0237103 A1 * 9/2011 Harlan ..... H01R 13/2414 439/271
2012/0196487 A1 * 8/2012 Dobler ..... H01R 13/7033 439/668
2013/0183867 A1 * 7/2013 Wu ..... H01R 24/58 439/668

* cited by examiner

*Primary Examiner* — Abdullah Riyami
*Assistant Examiner* — Vladimir Imas
(74) *Attorney, Agent, or Firm* — Locke Lord LLP; Tim Tingkang Xia, Esq.

(57) ABSTRACT

A receptacle connector used for an audio plug connector having a male end to be inserted therein, includes an insulating body, and at least one first terminal and two second terminals disposed inside the insulating body and entering the receiving cavity to contact the male end. The insulating body has an interface opened at a front end, and a receiving cavity extending backward from the interface and used for receiving the male end. The first terminal is located on a side of the male end. The two second terminals are located below or above the male end, and are approximately located on a same plane. In a height direction, two second terminals are approximately located on a same plane and only occupy a height space of one terminal.

20 Claims, 8 Drawing Sheets

RECEPTACLE CONNECTOR

CROSS-REFERENCE TO RELATED APPLICATION

This non-provisional application claims priority under 35 U.S.C. §119(a) on Patent Application No. 201420528230.0 filed in P.R. China on Sep. 11, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a receptacle connector, and more particularly to an audio receptacle connector.

BACKGROUND OF THE INVENTION

Please refer to Chinese Patent CN201220456181.5, which discloses an audio connector 100. The audio connector 100 includes an insulating body 1, multiple conductive terminals 2 received inside the insulating body 1, and a metal shell 3 covering the insulating body 1. A top wall 111 of the insulating body 1 is provided with a first receiving slot 1111, a second receiving slot 1112 located below the first receiving slot 1111, and an elastic arm 1113 located below the second receiving slot 1112 and extending backward. A bottom wall 112 is provided with a third receiving slot 1121. A first sidewall 113 is provided with a fourth receiving slot 1131, and a second sidewall 114 is provided with a fifth receiving slot 1141 opposite the fourth receiving slot 1131. The first and second receiving slots 1111, 1112 are parallel to each other and connected vertically. The multiple conductive terminals 2 include first, second, third, fourth, and fifth terminals 21, 22, 23, 24, 25 sequentially received inside the first, second, third, fourth, and fifth receiving slots 1111, 1112, 1121, 1131, 1141, and the first and second terminals 21, 22 form a switch used for detecting whether a butt plug is inserted in the electrical connector 100.

As for positions where multiple conductive terminals 2 are disposed in the audio connector 100, the first terminal 21 and the second terminal 22 are located, in a stacked manner, inside the first receiving slot 1111 and the second receiving slot 1112 at an upper end of the insulating body 1, and the third terminal 23 is located inside the third receiving slot 1121 at a lower end of the insulating body 1. Nowadays, products are developing to be light and thin. However, the foregoing positioning of the terminals increases the height of the entire audio connector and occupies more space. Further, because terminals having different functions need to be formed by punching using multiple sets of molds, the punching process is complicated.

Therefore, a heretofore unaddressed need exists in the art to address the aforementioned deficiencies and inadequacies.

SUMMARY OF THE INVENTION

In one aspect, the present invention is directed to a receptacle connector, in which multiple terminals are sequentially disposed and arranged to lower the height.

In one embodiment, a receptacle connector is used for an audio plug connector to be inserted therein. The audio plug connector has a male end. The receptacle connector includes an insulating body and at least one first terminal and two second terminals. An interface is opened at a front end of the insulating body, and a receiving cavity extends backward from the interface for receiving the male end entering from the interface. The at least one first terminal and the two second terminals are disposed inside the insulating body, and enter the receiving cavity to contact the male end. The first terminal is located on a side of the male end, the two second terminals are located below or above the male end, and the two second terminals are approximately located on a same plane.

In one embodiment, each of the two second terminals has a body portion, an extending arm extended forward from the body portion, and a contact portion bent laterally at a tail end of the extending arm. A blanking surface of the contact portion is used for contacting the male end. The two contact portions extend from adjacent sides of the two extending arms. Angles of lateral bending between the two contact portions and the two extending arms are 90 degrees.

In one embodiment, the receptacle connector further has at least one third terminal located at the other side of the male end. The first terminal, the second terminals, and the third terminal are formed by punching on a same strip and each have a soldering portion. The soldering portions are connected to the strip, and the multiple soldering portions are located on a same plane.

In one embodiment, the receptacle connector further has at least one third terminal located at the other side of the male end. The third terminal is a pair of switch terminals or a detection terminal, and the first terminal is a signal terminal. Two first terminals are provided, in which one of the first terminals near an inner side is a signal terminal, the other one of the first terminal near an outer side is a grounding terminal or microphone terminal. One of the two second terminals is a grounding terminal or a microphone terminal and the other is a signal terminal.

In one embodiment, the male end sequentially has multiple contact regions. In the two first terminals, the outermost first terminal has a body portion, an extending arm extends forward from the body portion, and a contact portion formed at a tail end of the extending arm. The contact portion contacts the frontmost contact region of the male end. The first terminal near an inner side has a body portion, an extending arm extends forward from the body portion, where the extending arm is in a plate-type U form, and a contact portion formed at a tail end of the extending arm. The contact portion contacts the rearmost contact region of the male end.

In one embodiment, the male end sequentially has multiple contact regions, and the two second terminals each have a contact portion, contacting two different contact regions near the middle of the male end.

In one embodiment, the receptacle connector further has at least one third terminal located at the other side of the male end. The first terminal, the second terminals, and the third terminal are all approximately formed by blanking and each have a body portion disposed horizontally, an extending arm extending forward from the body portion, a contact portion disposed at the extending arm, and a soldering portion formed by bending and extending downward from the body portion. The soldering portions are located on a same plane.

In one embodiment, the receptacle connector further has at least one third terminal located at the other side of the male end. Each of the first terminal, the second terminals, and the third terminal has a body portion, and a protruding portion is provided at the body portion. The protruding portion and the insulating body are fit and positioned.

In one embodiment, the receptacle connector further has at least one third terminal located at the other side of the male end. The third terminal is a pair of switch terminals, which are a movable terminal and a fixed terminal respectively. The movable terminal is located outside relative to the fixed terminal. Each of the movable terminal and the fixed terminal has a body portion, an extending arm extending forward from the body portion, and a contact portion located at a tail end of the extending arm. The extending arm of the movable terminal is in a plate-type U form, and the contact portion of the movable terminal contacts the contact portion of the fixed terminal.

In one embodiment, the contact portion of one of the movable terminal and the fixed terminal is a blanking surface, and contacts a plate surface of the other contact portion. The extending arm of the fixed terminal is formed by bending 90 degrees from a side of the body portion.

In one embodiment, a soldering portion is formed by extending and bending downward from the body portion of each of the movable terminal and the fixed terminal respectively, a connecting portion extends on a side, near the body portion, of the soldering portion, and a fixing portion extends and bends forward from the connecting portion.

In one embodiment, the insulating body is further provided with an insulating elastic arm. The insulating elastic arm extends backward from the front end of the insulating body and adjoins the receiving cavity. A groove is opened at a rear end of the insulating elastic arm. The receptacle connector further has at least one third terminal located at the other side of the male end. The third terminal is a pair of switch terminals. The switch terminals are a movable terminal and a fixed terminal respectively. The movable terminal has a contact portion and a pushing portion adjacent to each other, and the pushing portion is located in the groove.

In one embodiment, two first terminals are provided and are arranged in parallel on a side of the male end. Each of the first terminals has a body portions disposed horizontally. An extending arm extends forward from the body portion. The two body portions are located on a same plane.

In one embodiment, the receptacle connector further has at least one third terminal located at the other side of the male end. The third terminal is a pair of switch terminals. The switch terminals are a movable terminal and a fixed terminal respectively. Each of the movable terminal and the fixed terminal has a body portion disposed horizontally. An extending arm extends forward from the body portion. The body portion of the movable terminal and the body portion of the fixed terminal are located on a same plane.

In one embodiment, the receptacle connector further has at least one third terminal located at the other side of the male end. Each of the first terminal, the second terminals, and the third terminal has a body portion disposed horizontally. An extending arm extends forward from the body portion. The body portions of the first terminal and the third terminal are located on a same plane, and the body portions of the two second terminals are located on a same plane.

Compared with the related art, certain embodiments of the present invention, among other things, have the following beneficial advantages.

In the foregoing receptacle connector, the at least one first terminal and the two second terminals are disposed inside the insulating body. The first terminal is located on a side of the male end, and the two second terminals are located below or above the male end. When the male end of the audio plug connector enters the receiving cavity from the interface, the first terminal and the two second terminals contact the male end. Multiple terminals are designed in this manner that in a height direction, two second terminals are approximately located on a same plane and only occupy a height space of one terminal, so as to achieve a light and thin product while ensuring complete functions of a receptacle connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
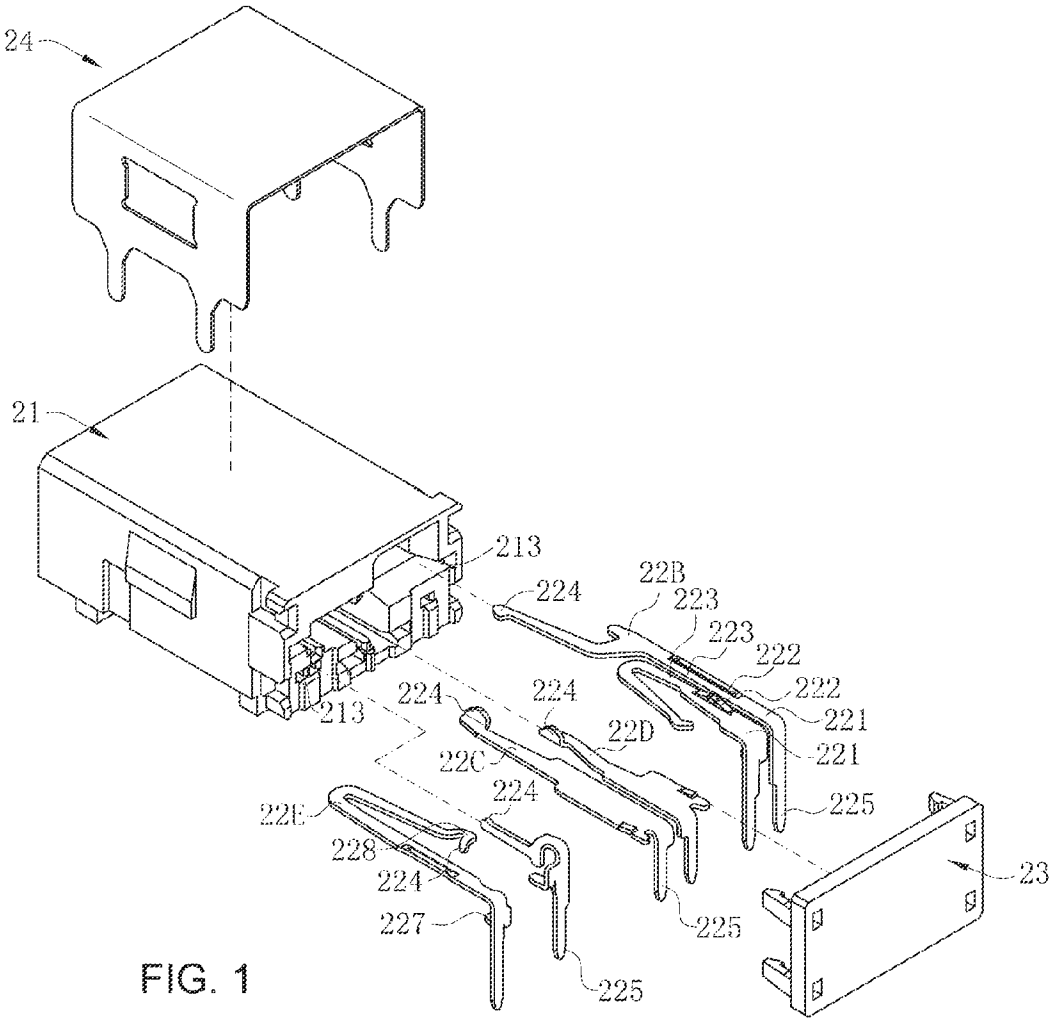
FIG. 1 is a three-dimensional exploded view of a receptacle connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a receptacle connector.

Figure 7:
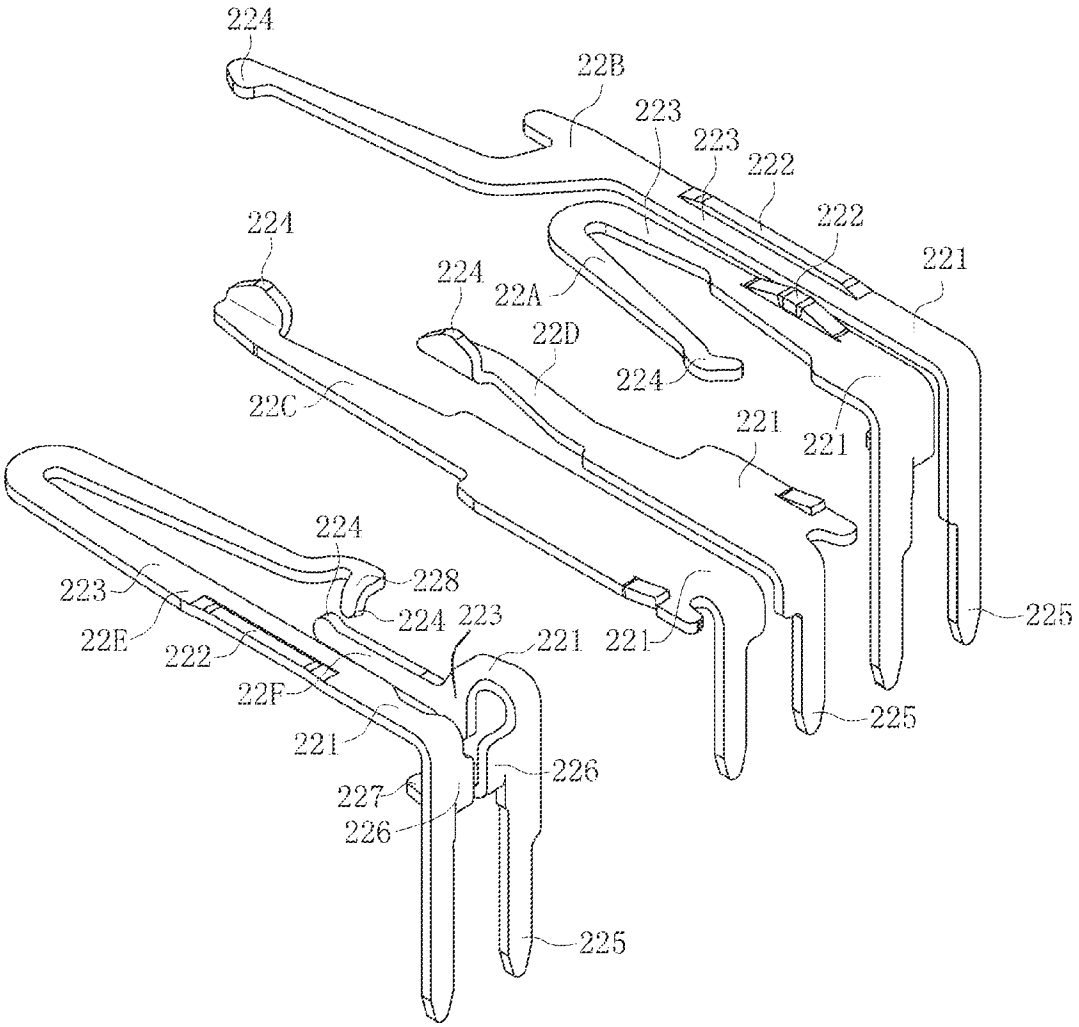
FIG. 7 is a schematic view of terminals in a receptacle connector according to one embodiment of the present invention.

As shown in FIG. 1 and FIG. 7, a receptacle connector 2 includes an insulating body 21, two first terminals 22A, 22B, two second terminals 22C, 22D, and two third terminals 22E, 22F respectively fixed at the insulating body 21, a rear cap 23 mounted at a rear end of the insulating body 21, and a metal shell 24 covering the insulating body 21. The first terminal 22A is a left signal terminal 22A, and the first terminal 22B is a grounding terminal or microphone terminal 22B. The second terminal 22C is a grounding terminal or microphone terminal 22C, and the second terminal 22D is a right signal terminal 22D. The third terminals 22E, 22F are a pair of switch terminals 22E, 22F. The third terminal 22E is a movable terminal 22E, and the third terminal 22F is a fixed terminal 22F. The rear cap 23 is used for fitting and positioning the two first terminals 22A, 22B, the two second terminals 22C, 22D, and the two third terminals 22E, 22F.

Figure 2:
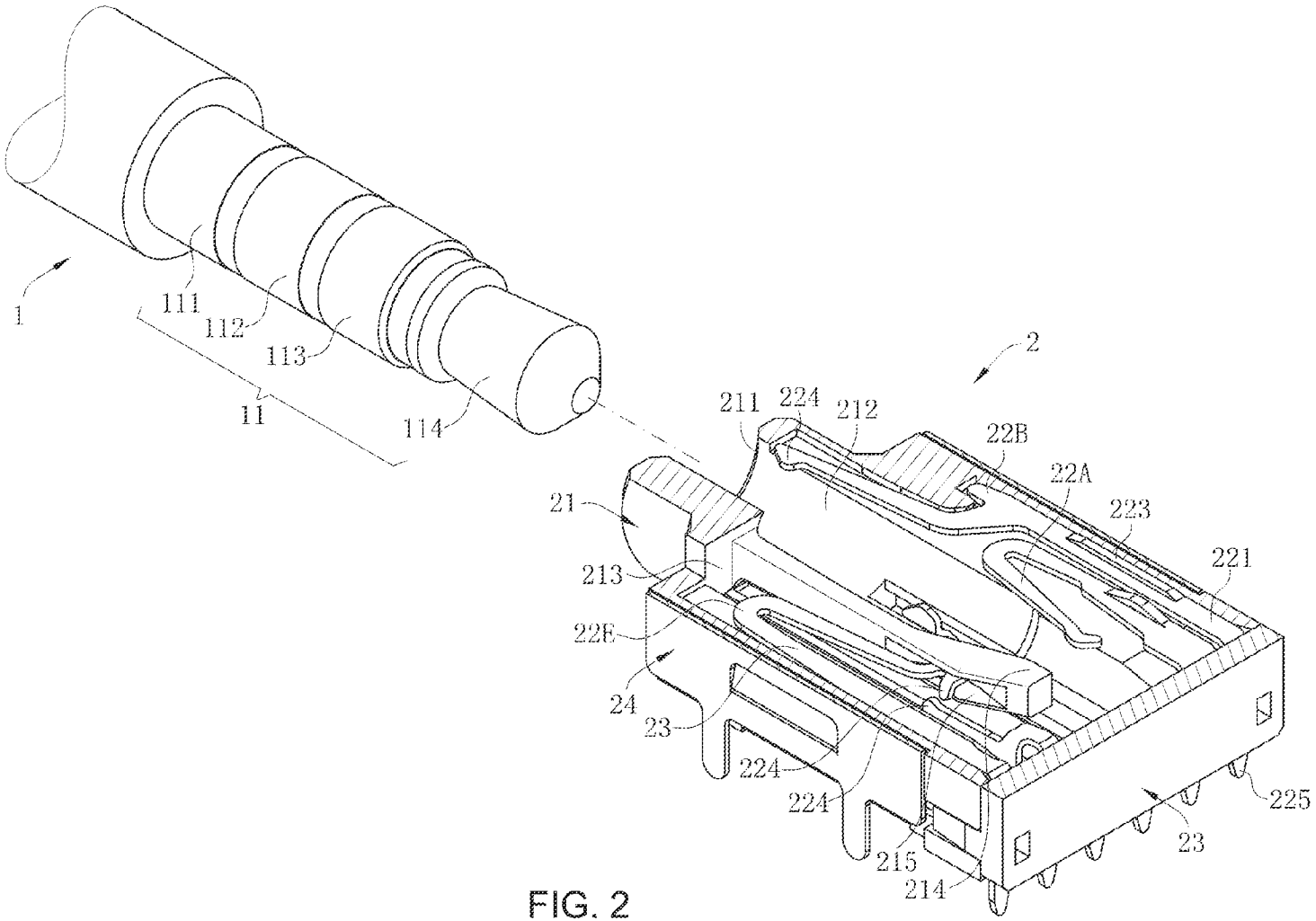
FIG. 2 is a schematic view of an audio plug connector that is not inserted in a receptacle connector according to one embodiment of the present invention.
Figure 3:
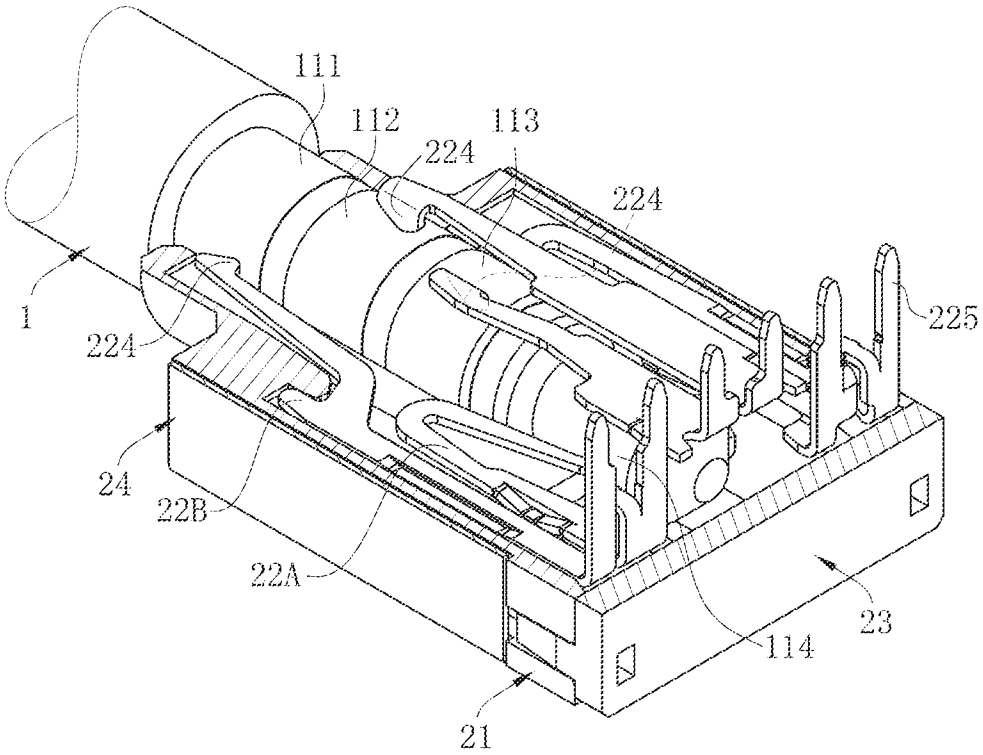
FIG. 3 is a schematic view of an audio plug connector that is inserted in a receptacle connector according to one embodiment of the present invention.

As shown in FIG. 2, the foregoing receptacle connector 2 is used for an audio plug connector 1 to be inserted therein. The audio plug connector 1 has a male end 11. The male end 11 sequentially has four contact regions. The four contact regions are, from front to back, a first contact region 111, a second contact region 112, a third contact region 113, and a fourth contact region 114, respectively. The fourth contact region 114 is located at the end. Alternatively, in other embodiments, the male end 11 may also have three contact regions sequentially, or the male end 11 sequentially has five or even more contact regions.

As shown in FIG. 1 and FIG. 2, an interface 211 is opened at a front end of the insulating body 21. A receiving cavity 212 is disposed to extend backward from the interface 211. The receiving cavity 212 is used for receiving the male end 11 to enter from the interface 211. Multiple terminal slots 213 open forward from a rear end of the insulating body 21, and the multiple terminal slots 213 are all in communication with the receiving cavity 212. The multiple terminal slots 213 are generally used for receiving the switch terminal or a detection terminal (not shown, and same hereinafter), the signal terminal, the grounding terminal, and the microphone terminal. If two of the terminal slots 213 receive the switch terminals 22E, 22F, the switch terminals 22E, 22F contact each other, and the switch terminals 22E, 22F do not need to contact the male end 11 to achieve the objective of detection or switching, then the two terminal slots 213 do not have to be in communication with the receiving cavity 212. In this embodiment, the two terminal slots 213 and the receiving cavity 212 are in communication with each other. Alternatively, in other embodiments, it is also possible that the two terminal slots 213 and the receiving cavity 212 are not in communication with each other. The insulating body 21 is further provided with an insulating elastic arm 214. The insulating elastic arm 214 extends backward from the front end of the insulating body 21 and adjoins the receiving cavity 212 and the terminal slots 213. The insulating elastic arm 214 is located between the receiving cavity 212 and the terminal slots 213, and a groove 215 is opened at a rear end of the insulating elastic arm 214.

As shown in FIGS. 1, 2, 4, and 7, the two first terminals 22A, 22B, the two second terminals 22C, 22D, and the two third terminals 22E, 22F are sequentially fixed at the insulating body 21. When the male end 11 of the audio plug connector 1 is inserted in the receiving cavity 212, the two third terminals 22E, 22F disposed on a left side of the male end 11 are the pair of switch terminals 22E, 22F, and the two first terminals 22A, 22B disposed on a right side of the male end 11 are approximately located on a same plane, in which one is the left signal terminal 22A and the other is the grounding terminal or microphone terminal 22B. The two second terminals 22C, 22D are also sequentially disposed laterally below the male end 11, in which one is the grounding terminal or microphone terminal 22C and the other is the right signal terminal 22D, and the two second terminals 22C, 22D below the male end 11 are approximately located on a same plane. In other embodiments, the number of the terminals may also be five, that is, one first terminal 22A disposed on the right side of the male end 11 is the left signal terminal 22A. In one embodiment, the number of the terminals is four, that is, one first terminal 22A disposed on the right side of the male end 11 is the left signal terminal 22A, one third terminal 22E disposed on the left side of the male end 11 is the detection terminal (not shown). In certain embodiments, the two second terminals 22C, 22D disposed below the male end 11 may also be changed to be above the male end 11. The two first terminals 22A, 22B, the two second terminals 22C, 22D, the two third terminals 22E, 22F may increase or decrease in number or may be replaceable, so that the procedures and replacement process are convenient.

Figure 5:
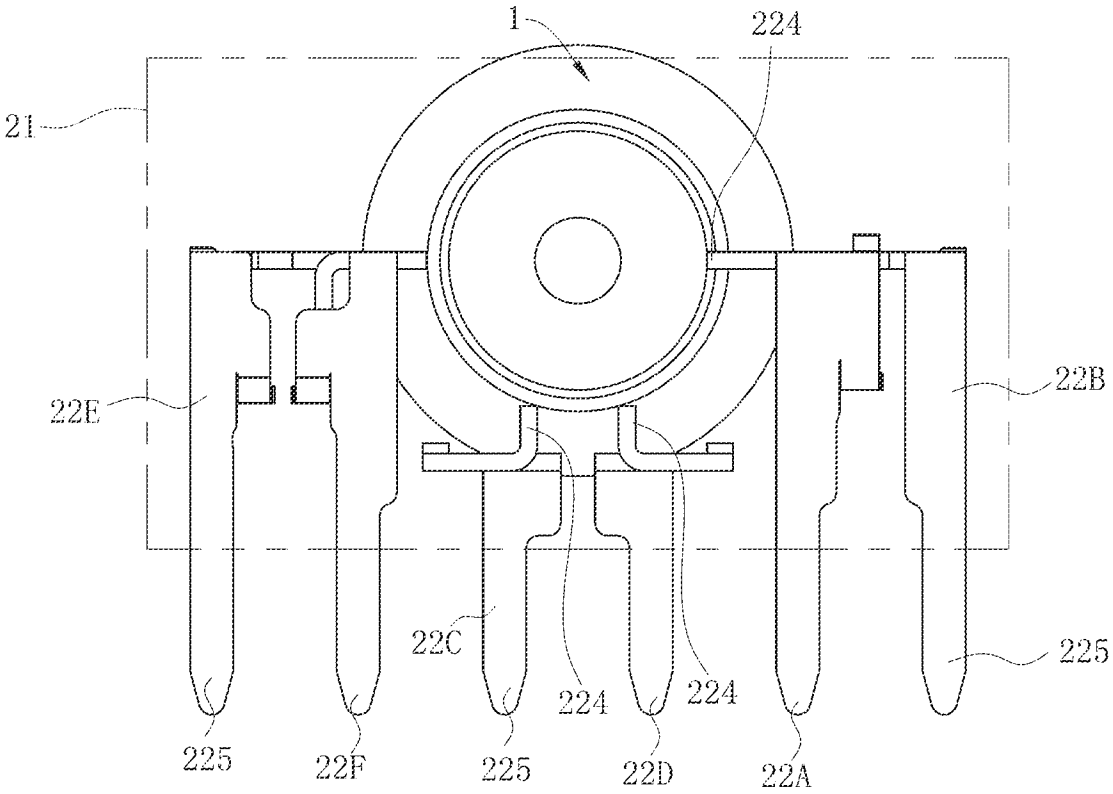
FIG. 5 is a rear view of terminals in a receptacle connector according to one embodiment of the present invention after fitting a male end in an audio plug connector.
Figure 6:
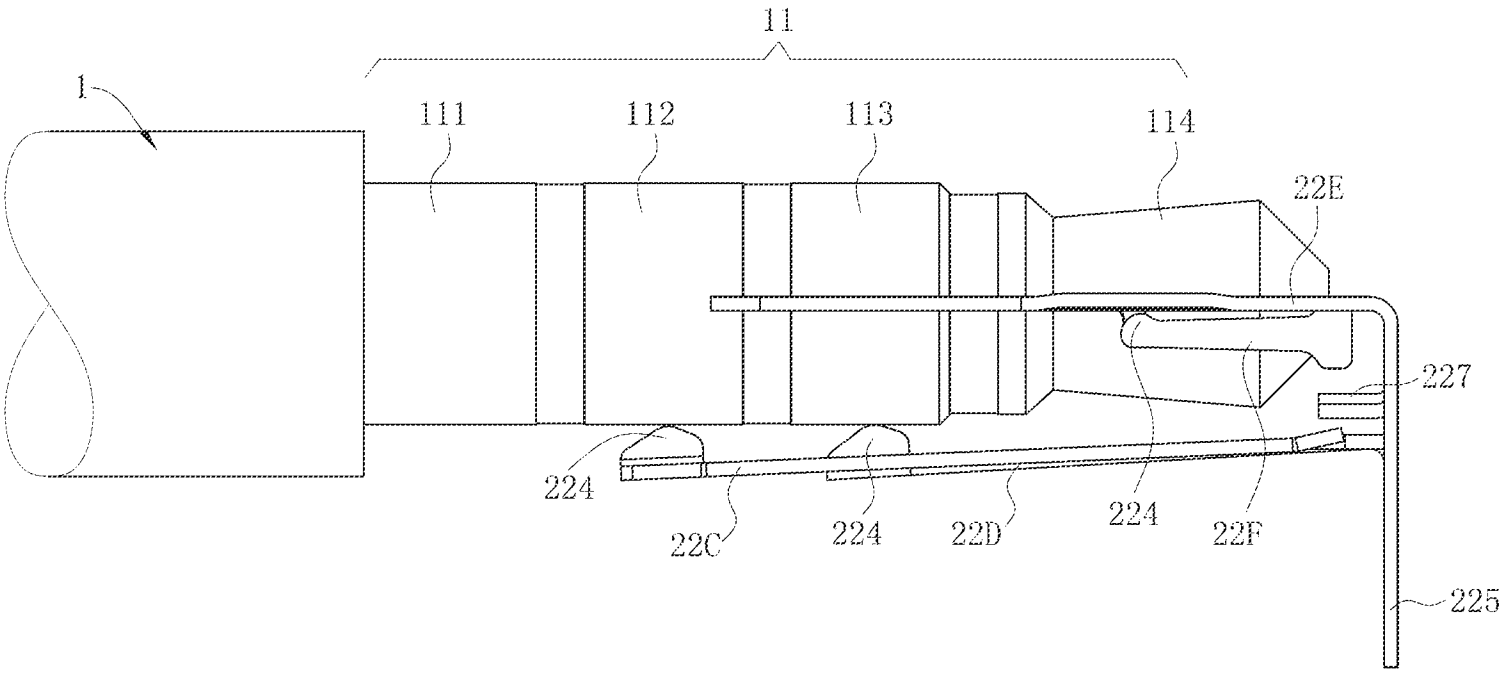
FIG. 6 is a side view of terminals in a receptacle connector according to one embodiment of the present invention after fitting a male end in an audio plug connector.

As shown in FIGS. 5-7, the two first terminals 22A, 22B, the two second terminals 22C, 22D, and the two third terminals 22E, 22F are all approximately formed by blanking a metal plate and have a body portion 221 respectively, and the body portion 221 is horizontally disposed. The body portions 221 of the two first terminals 22A, 22B are located on a same plane, the body portions 221 of the two second terminals 22C, 22D are located on a same plane, and the body portions 221 of the two third terminals 22E, 22F are located on a same plane. In this embodiment, the body portions 221 of the two first terminals 22A, 22B and the body portions 221 of the two third terminals 22E, 22F are also located on a same plane. Alternatively, in other embodiments, the body portions 221 of the two first terminals 22A, 22B and the body portions 221 of the two third terminals 22E, 22F may also be located on two different planes.

As shown in FIGS. 5-7, an extending arm 223 extends forward from the body portion 221, a contact portion 224 is formed at a tail end of the extending arm 223, and the multiple contact portions 224 are located around the male end 11 respectively. Except that the contact portions 224 of the switch terminals 22E, 22F contact each other, the rest contact portions 224 enter the receiving cavity 212 to contact the male end 11. A soldering portion 225 is formed by extending and bending downward from the body portion 221. The two first terminals 22A, 22B, the two second terminals 22C, 22D, and the two third terminals 22E, 22F are formed by punching on a same strip. The multiple soldering portions 225 are connected to the strip (not shown) respectively, and sequentially arranged and located on a same plane. The sequence is the soldering portions 225 of the two third terminals 22E, 22F on the left side of the male end 11, followed by the soldering portions 225 of the two second terminals 22C, 22D below the male end 11, and finally the soldering portions 225 of the two first terminals 22A, 22B on the right side of the male end 11. Moreover, as seen from the top, the two first terminals 22A, 22B, the two second terminals 22C, 22D, and the two third terminals 22E, 22F are also sequentially arranged horizontally. The sequence is the two third terminals 22E, 22F on the left side of the male end 11, followed by the two second terminals 22C, 22D below the male end 11, and finally the two first terminals 22A, 22B on the right side of the male end 11.

Figure 4:
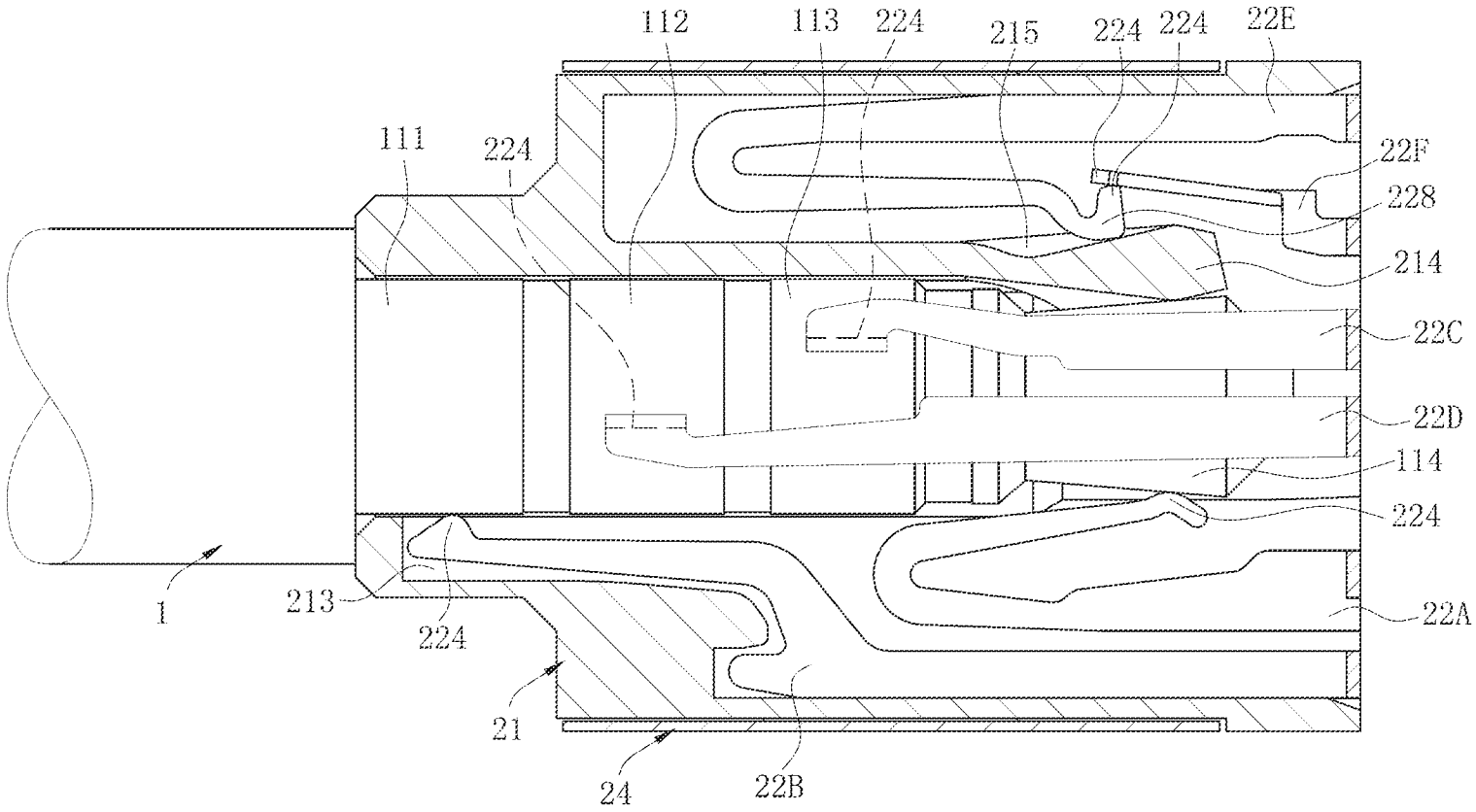
FIG. 4 is a sectional view from another angle of FIG. 3.

As shown in FIG. 2 and FIG. 4, the pair of switch terminals 22E, 22F disposed on the left side of the male end 11 are a movable terminal 22E and a fixed terminal 22F respectively, the movable terminal 22E is located outside relative to the fixed terminal 22F, and the fixed terminal 22F is near the receiving cavity 212.

As shown in FIGS. 1, 2, 4, and 7, a protruding portion 222 is provided at the body portion 221 of the movable terminal 22E. The protruding portion 222 may be disposed in a protruding manner or may also be formed in a penetrating manner, and is used for positioning the movable terminal 22E to the insulating body 21 in a more reinforced manner. The extending arm 223 of the movable terminal 22E is in a plate-type U form, and has a long arm of force and desirable elasticity. The body portion 221 and the extending arm 223 are located on a same horizontal plane. The contact portion 224 is formed by bending from a side of the extending arm 223. The contact portion 224 and the extending arm 223 are disposed with an obtuse angle between the contact portion 224 and the extending arm 223. A pushing portion 228 is provided at a position, near the contact portion 224, of the extending arm 223 and is located in the groove 215 of the insulating elastic arm 214. A soldering portion 225 is formed by extending and bending downward from the body portion 221 of the movable terminal 22E. A connecting portion 226 extends on a side, near the body portion 221, of the soldering portion 225. A fixing portion 227 bends and extends forward from the connecting portion 226 and is used for fixing the movable terminal 22E to the insulating body 21.

As shown in FIGS. 1, 4, and 7, the extending arm 223 of the fixed terminal 22F is formed by bending 90 degrees from a side of the body portion 221. The extending arm 223 and the body portion 221 are disposed perpendicular to each other, and the extending arm 223 of the fixed terminal 22F and the extending arm 223 of the movable terminal 22E are also disposed perpendicular to each other. The contact portion 224 of the fixed terminal 22F is directly formed from the extending arm 223 of the fixed terminal 22F without bending. A soldering portion 225 is also formed by extending and bending downward from the body portion 221 of the fixed terminal 22F. A connecting portion 226 extends on a side, near the body portion 221, of the soldering portion 225. A fixing portion 227 bends and extends forward from the connecting portion 226.

As shown in FIGS. 2-5, the contact portion 224 of the movable terminal 22E and the contact portion 224 of the fixed terminal 22F are both plate surfaces and contact each other, but do not contact the male end 11. When the male end 11 is inserted inside the receiving cavity 212, the male end 11 pushes the insulating elastic arm 214 inside the insulating body 21, so that an inner wall of the groove 215 of the insulating elastic arm 214 abuts the pushing portion 228 of the movable terminal 22E, enabling the contact portion 224 of the movable terminal 22E and the contact portion 224 of the fixed terminal 22F to contact each other. The movable terminal 22E has desirable elasticity and a large movable space. Meanwhile, because the pushing portion 228 is disposed inside the groove 215, even during a pushing process, the pushing portion 228 may also be stably positioned inside the groove 215, and a case in which the pushing portion 228 slips and the insulating elastic arm 214 cannot be pushed is avoided.

Alternatively, in other embodiments, the structure may also be as follows.

In a second embodiment, the contact portion 224 of the movable terminal 22E is formed directly from the extending arm 223 of the movable terminal 22E without bending. In this way, the contact portion 224 of the movable terminal 22E is a blanking surface contacting a plate surface of the contact portion 224 of the fixed terminal 22F. The movable terminal 22E has desirable elasticity and a large movable space.

Figure 8:
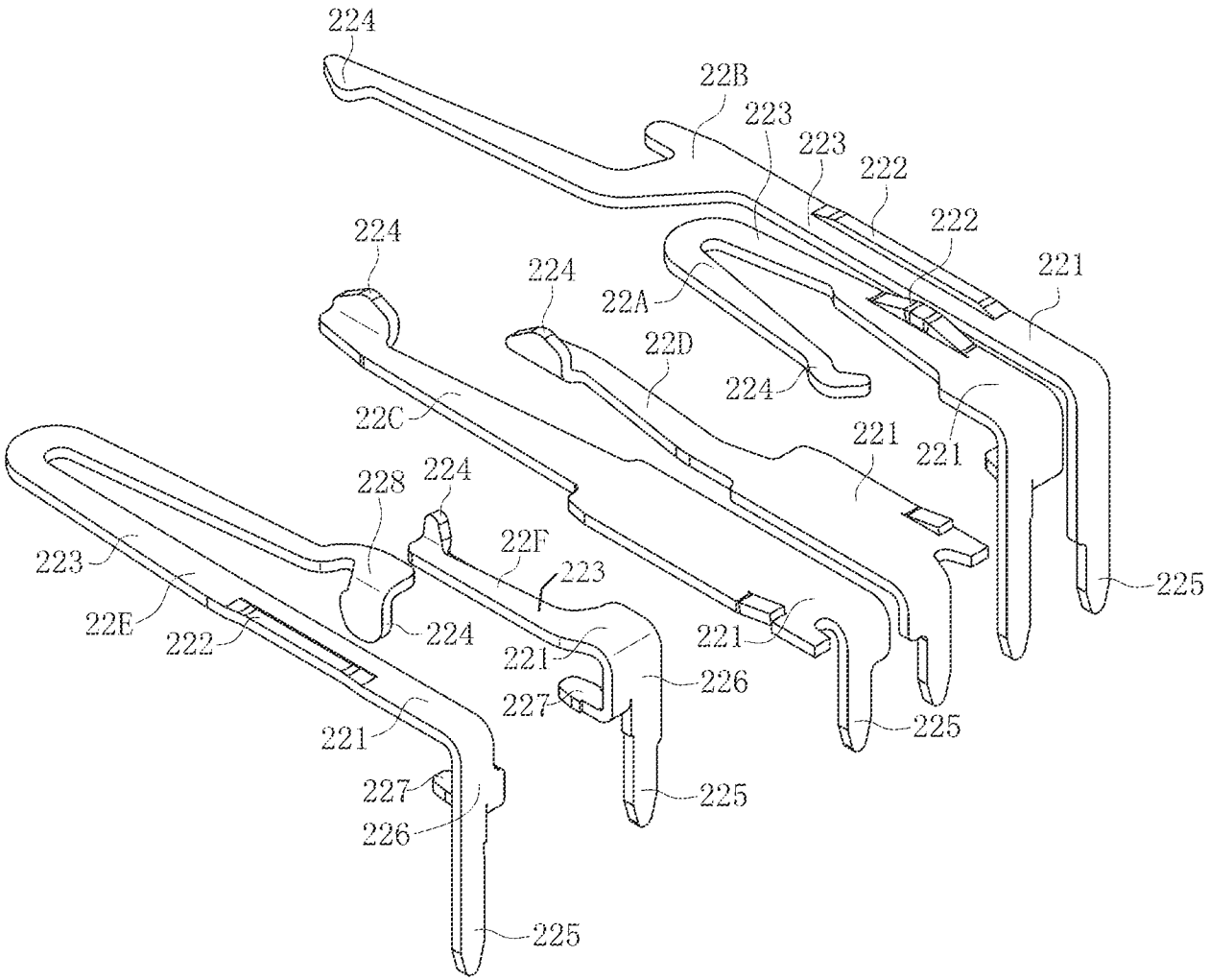
FIG. 8 is a schematic view of terminals in a receptacle connector according to another embodiment of the present invention.

As shown in FIG. 8, in a third embodiment, the extending arm 223 of the fixed terminal 22F bends and extends forward directly from the body portion 221. The extending arm 223 of the fixed terminal 22F and the extending arm 223 of the movable terminal 22E are disposed in parallel. The contact portion 224 is formed by bending from a side of the extending arm 223. The contact portion 224 and the extending arm 223 are disposed with an obtuse angle between the contact portion 224 and the extending arm 223. In this way, the contact portion 224 of the fixed terminal 22F is also a plate surface contacting a plate surface of the contact portion 224 of the movable terminal 22E. The fixed terminal 22F has high rigidity and has a large normal force in the contact with the movable terminal 22E.

In a fourth embodiment, the extending arm 223 of the fixed terminal 22F bends and extends forward from the body portion 221. The extending arm 223 of the fixed terminal 22F and the extending arm 223 of the movable terminal 22E are disposed in parallel. The contact portion 224 is also formed directly from the extending arm 223 without bending. In this way, the contact portion 224 of the fixed terminal 22F is a blanking surface contacting a plate surface of the contact portion 224 of the movable terminal 22E. Only the contact portion 224 of the movable terminal 22E is bent. The fixed terminal 22F has high rigidity and has a large normal force in the contact with the movable terminal 22E.

In a fifth embodiment, the contact portion 224 of the movable terminal 22E is formed directly from the extending arm 223 of the movable terminal 22E without bending. The extending arm 223 of the fixed terminal 22F bends and extends forward from the body portion 221. The extending arm 223 of the fixed terminal 22F and the extending arm 223 of the movable terminal 22E are disposed in parallel. The contact portion 224 of the fixed terminal 22F is formed by bending from a side of the extending arm 223. The contact portion 224 and the extending arm 223 of the fixed terminal 22F are disposed with an obtuse angle between the contact portion 224 and the extending arm 223. In this way, the contact portion 224 of the fixed terminal 22F is a plate surface contacting a blanking surface of the contact portion 224 of the movable terminal 22E. Only the contact portion 224 of the fixed terminal 22F is bent. The fixed terminal 22F has high rigidity and has a large normal force in the contact with the movable terminal 22E.

As shown in FIGS. 3-6, for the two second terminals 22C, 22D located below the male end 11, the two contact portions 224 both extend from adjacent sides of the tail ends of the two extending arms 223. Angles of lateral bending between the two contact portions 224 and the two extending arms 223 are 90 degrees. A blanking surface of the contact portion 224 is used for contacting the male end 11, which has a sufficient normal force in the contact. A protruding portion 222 is also provided at the body portion 221, may be disposed in a protruding manner or may also be formed in a penetrating manner, and positions the two second terminals 22C, 22D more desirably. The two second terminals 22C, 22D are horizontally arranged below the male end 11 on left and right sides. The contact portion 224 of the second terminal 22C near the left side contacts the second contact region 112, and the contact portion 224 of the second terminal 22D near the right side contacts the third contact region 113.

As shown in FIGS. 3-6, for the two first terminals 22A, 22B located on the right side of the male end 11, the extending arm 223 of the first terminal 22A near the receiving cavity 212 is in a plate-type U form and has a long arm of force and desirable elasticity, and the contact portion 224 of the first terminal 22A is a blanking surface contacting the fourth contact region 114; the contact portion 224 of the first terminal 22B away from the receiving cavity 212 is a blanking surface contacting the first contact region 111, which has a sufficient normal force in the contact. A protruding portion 222 is also provided at the body portion 221, may be disposed in a protruding manner or may also be formed in a penetrating manner, and positions the two first terminals 22A, 22B more desirably. The extending arms 223 and the contact portions 224 of the two first terminals 22A, 22B are all located on a same horizontal plane, ensuring convenient synchronous riveting.

As shown in FIGS. 3-6, the contact portion 224 of the second terminal 22C near the left side contacts the bottom of the second contact region 112, the contact portion 224 of the second terminal 22D near the right side contacts the bottom of the third contact region 113, and a position where the contact portion 224 of the second terminal 22C contacts the second contact region 112 is symmetrical to a position where the contact portion 224 of the second terminal 22D contacts the third contact region 113. The contact portion 224 of the first terminal 22A near the left side contacts the right side of the fourth contact region 114, the contact portion 224 of the first terminal 22B near the right side contacts the right side of the first contact region 111, and positions where the contact portions 224 of the two first terminals 22A, 22B contact the fourth contact region 114 and the first contact region 111 respectively are located at a same straight line, and are higher than positions where the contact portions 224 of the two second terminals 22C, 22D contact the second contact region 112 and the third contact region 113 respectively.

In summary, the receptacle connector according to certain embodiments of the present invention, among other things, has the following beneficial advantages:

(1) In the foregoing receptacle connector 2, the at least one first terminal 22A and the two second terminals 22C, 22D are disposed inside the insulating body 21. The first terminal 22A is located at a side of the male end 11, and the two second terminals 22C, 22D are located below or above the male end 11. When the male end 11 of the audio plug connector 1 enters the receiving cavity 212 from the interface 211, the first terminal 22A and the two second terminals 22C, 22D contact the male end. Multiple terminals are designed in this manner that in a height direction, two second terminals 22C, 22D are approximately located on a same plane and only occupy a height space of one terminal, so as to achieve a light and thin product in a case of ensuring complete functions of the receptacle connector 2.

(2) The two first terminals 22A, 22B, the two second terminals 22C, 22D, and the two third terminals 22E, 22F are formed by punching on a same strip. The multiple soldering portions 225 are connected to the strip respectively, the multiple soldering portions 225 are sequentially arranged and located on a same plane, and when being soldered on a circuit board, the soldering portions are easy to solder and only occupy one row of space on the circuit board, thereby facilitating placement of other electrical elements. Meanwhile, integrated punching may be implemented for the two first terminals 22A, 22B, the two second terminals 22C, 22D, and the two third terminals 22E, 22F altogether, thereby solving a difficult problem that multiple sets of molds are needed to form different functional terminals by punching, simplifying a punching process, and facilitating one-time electroplating.

Meanwhile, for the two first terminals 22A, 22B, the two second terminals 22C, 22D, the two third terminals 22E, 22F, the sequence is the soldering portions 225 of the two third terminals 22E, 22F on the left side of the male end 11, followed by the soldering portions 225 of the two second terminals 22C, 22D below the male end 11, and finally the soldering portions 225 of the two first terminals 22A, 22B on the right side of the male end 11. In combination, the two first terminals 22A, 22B, the two second terminals 22C, 22D, and the two third terminals 22E, 22F are approximately formed by blanking. In this way, the terminal has a simple fabrication process, and it becomes convenient to insert the two first terminals 22A, 22B, the two second terminals 22C, 22D, and the two third terminals 22E, 22F forward one time from the rear end of the insulating body 21.

Moreover, as seen from the top, the two first terminals 22A, 22B, the two second terminals 22C, 22D, and the two third terminals 22E, 22F are horizontally arranged sequentially. The sequence is the two third terminals 22E, 22F on the left side of the male end 11, followed by the two second terminals 22C, 22D below the male end 11, and finally the two first terminals 22A, 22B on the right side of the male end 11. The contact portions 224 of the two first terminals 22A, 22B, the two second terminals 22C, 22D, and the two third terminals 22E, 22F contact the first contact region 111, the second contact region 112, the third contact region 113, and the fourth contact region 114 of the male end 11 in a staggered manner respectively. In this way, the two first terminals 22A, 22B, the two second terminals 22C, 22D, and the two third terminals 22E, 22F are connected to a strip in a punching process, thereby ensuring a high material utilization rate and low waste.

(3) For the two second terminals 22C, 22D located below the male end 11, the contact portion 224 of the second terminal 22C near the left side contacts the second contact region 112, and the contact portion 224 of the second terminal 22D near the right side contacts the third contact region 113. For the two first terminals 22A, 22B located on the right side of the male end 11, the contact portion 224 of the first terminal 22A near the receiving cavity 212 contacts the fourth contact region 114, and the contact portion 224 of the first terminal 22B away from the receiving cavity 212 contacts the first contact region 111. The positions where the four contact portions 224 contact the male end 11 are not all on a same plane and are scattered. The moving directions of the extending arms 223 of the two first terminals 22A, 22B, the two second terminals 22C, 22D, and the two third terminals 22E, 22F are also not all on a same plane, so as to exert an auxiliary holding effect for positioning of the male end 11 inside the receiving cavity 212.

In addition, the two first terminals 22A, 22B, the two second terminals 22C, 22D, the body portions 221 of the two third terminals 22E, 22F are all disposed in parallel and adjacent terminals are also opposite each other with cross sections. In this way, an overlapped area is reduced, signal interference between the two first terminals 22A, 22B, the two second terminals 22C, 22D, and the two third terminals 22E, 22F having different functions is effectively alleviated, and the quality of signal transmission is improved.

Alternatively, the separate arrangement of multiple contact portions 224 facilitates processing and fabrication, thereby increasing a product yield rate.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A receptacle connector, used for an audio plug connector to be inserted therein, the audio plug connector having a male end, comprising:

an insulating body, having an interface opened at a front end thereof, and a receiving cavity extended backward from the interface, wherein the receiving cavity is used for receiving the male end to enter from the interface; and at least one first terminal and two second terminals, disposed inside the insulating body and entering the receiving cavity to contact the male end, wherein the first terminal is located on a side of the male end, the two second terminals are located below or above the male end, each of the two second terminals comprises a body portion having a top plate surface and an opposite, bottom plate surface, the two top plate surfaces are approximately located on a same plate, and the two bottom plate surfaces are approximately located on a same plane.

2. The receptacle connector according to claim 1, wherein an extending arm extended forward from each of the body portions, a contact portion bent laterally at a tail end of the extending arm, and a blanking surface of the contact portion is used for contacting the male end.

3. The receptacle connector according to claim 2, wherein the two contact portions extend from adjacent sides of the two extending arms.

4. The receptacle connector according to claim 2, wherein angles of lateral bending between the two contact portions and the two extending arms are 90 degrees.

5. The receptacle connector according to claim 1, further comprising at least one third terminal located at the other side of the male end, wherein the first terminal, the second terminals, and the third terminal are formed by punching on a same strip, each of the first terminal, the second terminals, and the third terminal has a soldering portion, the soldering portions are connected to the strip, and the multiple soldering portions are located on a same plane.

6. The receptacle connector according to claim 1, further comprising at least one third terminal located at the other side of the male end, wherein the third terminal is a pair of switch terminals or a detection terminal, and the first terminal is a signal terminal.

7. The receptacle connector according to claim 6, wherein two first terminals are provided, the first terminal near an inner side is a signal terminal, the first terminal near an outer side is a grounding terminal or a microphone terminal, and one of the two second terminals is a grounding terminal or a microphone terminal and the other is a signal terminal.

8. The receptacle connector according to claim 7, wherein the male end sequentially has multiple contact regions, in the two first terminals, the outermost first terminal has a body portion, an extending arm extends forward from the body portion, a contact portion is formed at a tail end of the extending arm, the contact portion contacts the frontmost contact region of the male end, the first terminal near an inner side has a body portion, an extending arm extends forward from the body portion, the extending arm is in a plate-type U form, a contact portion is formed at a tail end of the extending arm, and the contact portion contacts the rearmost contact region of the male end.

9. The receptacle connector according to claim 1, wherein the male end sequentially has multiple contact regions, and the two second terminals each have a contact portion respectively, contacting two different contact regions near the middle of the male end.

10. The receptacle connector according to claim 1, further comprising at least one third terminal located at the other side of the male end, wherein the first terminal, the second terminals, and the third terminal are all approximately formed by blanking and each of the first terminal and the third terminal has a body portion respectively, each of the body portions of the first terminal, the second terminals and the third terminal is disposed horizontally, an extending arm extends forward from the body portion, a contact portion is disposed at the extending arm, a soldering portion is formed by bending and extending downward from the body portion, and the soldering portions are located on a same plane.

11. The receptacle connector according to claim 1, further comprising at least one third terminal located at the other side of the male end, wherein the first terminal and the third terminal each have a body portion respectively, a protruding portion is provided at each of the body portions of the first terminal, the second terminals and the third terminal, and the protruding portion and the insulating body are fit and positioned.

12. The receptacle connector according to claim 1, further comprising at least one third terminal located at the other side of the male end, wherein the third terminal is a pair of switch terminals, the switch terminals are a movable terminal and a fixed terminal respectively, the movable terminal is located outside relative to the fixed terminal, the movable terminal and the fixed terminal have a body portion respectively, an extending arm extends forward from the body portion, a contact portion is located at a tail end of the extending arm, the extending arm of the movable terminal is in a plate-type U form, and the contact portion of the movable terminal contacts the contact portion of the fixed terminal.

13. The receptacle connector according to claim 12, wherein the contact portion of one of the movable terminal and the fixed terminal is a blanking surface, contacting a plate surface of the other contact portion.

14. The receptacle connector according to claim 12, wherein the extending arm of the fixed terminal is formed by bending 90 degrees from a side of the body portion.

15. The receptacle connector according to claim 12, wherein a soldering portion is formed by extending and bending downward from the body portion of each of the movable terminal and the fixed terminal respectively, a connecting portion extends on a side, near the body portion, of the soldering portion, and a fixing portion extends and bends forward from the connecting portion.

16. The receptacle connector according to claim 1, wherein the insulating body further comprises an insulating elastic arm, the insulating elastic arm extends backward from the front end of the insulating body and adjoins the receiving cavity, a groove is opened at a rear end of the insulating elastic arm, the receptacle connector further comprises at least one third terminal located at the other side of the male end, the third terminal is a pair of switch terminals, the switch terminals are a movable terminal and a fixed terminal respectively, the movable terminal has a contact portion and a pushing portion adjacent to each other, and the pushing portion is located in the groove.

17. The receptacle connector according to claim 1, wherein two first terminals are provided and are arranged in parallel on a side of the male end, each first terminal has a body portion, the body portion is disposed horizontally, an extending arm extends forward from the body portion, and the two body portions are located on a same plane.

18. The receptacle connector according to claim 1, further comprising at least one third terminal located at the other side of the male end, wherein the third terminal is a pair of switch terminals, the switch terminals are a movable terminal and a fixed terminal respectively, the movable terminal and the fixed terminal have a body portion respectively, the body portion is disposed horizontally, an extending arm extends forward from the body portion, and the body portion of the movable terminal and the body portion of the fixed terminal are located on a same plane.

19. The receptacle connector according to claim 1, further comprising at least one third terminal located at the other side of the male end, the first terminal, and the third terminal have a body portion respectively, each of the body portions of the first terminal, the second terminals and the third terminal is disposed horizontally, an extending arm extends forward from the body portion, the body portions of the first terminal and the third terminal are located on a same plane.

20. A receptacle connector, used for an audio plug connector to be inserted therein, the audio plug connector having a male end, comprising:

an insulating body, having an interface opened at a front end thereof, and a receiving cavity extended backward from the interface, wherein the receiving cavity is used for receiving the male end to enter from the interface; and at least one first terminal and two second terminals, disposed inside the insulating body and entering the receiving cavity to contact the male end, wherein the first terminal is located on a side of the male end, the two second terminals are located below or above the male end, and the two second terminals are approximately located on a same plane; and at least one third terminal located at the other side of the male end, wherein the first terminal, the second terminals, and the third terminal are all approximately formed by blanking and each have a body portion respectively, the body portion is disposed horizontally, an extending arm extends forward from the body portion, a contact portion is disposed at the extending arm, a soldering portion is formed by bending and extending downward from the body portion, and the soldering portions are located on a same plane.

* * * * *